US006570549B2

(12) United States Patent
Nakanishi et al.

(10) Patent No.: US 6,570,549 B2
(45) Date of Patent: May 27, 2003

(54) METHOD OF DRIVING A LIQUID CRYSTAL DISPLAY

(75) Inventors: Kunifumi Nakanishi, Kikuchi-gun (JP); Tomoya Teragaki, Kikuchi-gun (JP)

(73) Assignee: Advanced Display Inc., Kikuchi-gun (JP)

( * ) Notice: Subject to any disclaimer, the term of this patent is extended or adjusted under 35 U.S.C. 154(b) by 210 days.

(21) Appl. No.: 09/847,413

(22) Filed: May 3, 2001

(65) Prior Publication Data

US 2001/0048412 A1 Dec. 6, 2001

(30) Foreign Application Priority Data

May 26, 2000 (JP) ..... 2000-156515

(51) Int. Cl.[7] ..... G09G 3/36

(52) U.S. Cl. ..... 345/87; 345/94

(58) Field of Search ..... 345/87, 690, 693, 345/694, 90, 91, 92, 93, 94, 95, 96, 97, 98, 99, 100

(56) References Cited

U.S. PATENT DOCUMENTS 5,398,043 A * 3/1995 Takeda et al. ..... 345/94
5,686,932 A * 11/1997 Tomita ..... 345/94
6,359,607 B1 * 3/2002 Yanagi et al. ..... 345/94
6,417,906 B2 * 7/2002 Ohta et al. ..... 349/141

* cited by examiner

*Primary Examiner*—Vijay Shankar
*Assistant Examiner*—Nitin Patel
(74) *Attorney, Agent, or Firm*—Oblon, Spivak, McClelland, Maier & Neustadt, P.C.

(57) ABSTRACT

The present invention is directed to a method of driving a liquid crystal display, where said liquid crystal display includes steps of: setting said central electric potential of said source signals and said central electric potential of said common signals, in such a manner as to compensate a reduction of said electric potential of a pixel electrode induced by said gate signals in a case of the gradation where said amplitude of said source signals is large, and setting said central electric potential of said source signals, in such a manner that said central electric potential of said source signals is higher than said central electric potential of said source signals compensating said reduction of the electric potential induced by said gate signals in case of the gradation where said amplitude of said source signals is small.

6 Claims, 12 Drawing Sheets

METHOD OF DRIVING A LIQUID CRYSTAL DISPLAY

BACKGROUND OF THE INVENTION

The present invention relates to a liquid crystal display using a TFT, and more particularly to a method of driving a liquid crystal.

FIG. 1 shows the structure of a conventional liquid crystal display (LCD) using a Thin Film Transistor (TFT). A thin film transistor element 1, a source line 2, a gate line 3, a drain 4 and a pixel electrode 5 are formed on a glass substrate 6 to form a TFT substrate. A counter electrode 7 is formed on a glass substrate 8 to form an opposite substrate. The TFT substrate and the opposed substrate are provided in parallel with each other and a liquid crystal is interposed between the TFT substrate and the opposite substrate.

FIG. 2 shows an equivalent circuit for one pixel of FIG. 1.

In FIG. 2, the reference numeral 9 denotes a source signal to be applied to the source line 2 and the reference numeral 10 denotes a gate signal to be applied to the gate line 3. A symbol $C_{gd}$ represents a coupling capacitance between a gate and a drain, a symbol $C_{ds}$ represents a coupling capacitance between a source and a drain, and a symbol $C_{1c}$ represents a coupling capacitance of a liquid crystal interposed between a pixel electrode and a counter electrode. $C_s$ represents a retaining capacitance formed to enhance a retaining characteristic of a pixel and to improve a picture quality.

FIG. 3 shows a waveform of a signal to be applied to a pixel.

The source signal 9 is an alternating voltage having an amplitude $V_{sa}$ in which a central electric potential $V_{so}$ is a median. The amplitude $V_{sa}$ corresponds to a gradation to be displayed on a pixel. The gate signal 10 is set to the High level (hereinafter referred to as "Hi" level) only for one scanning period and to the Low level (hereinafter referred to as "Lo" level) for other periods. The reference numeral 11 denotes a waveform representing an electric potential of the pixel electrode 5.

First of all, when the gate signal 10 becomes the Hi level in an odd frame 101 shown in FIG. 3, the electric potential 11 of the pixel electrode 5 becomes have the level of the source signal 9. When the gate signal 10 becomes the Lo level, a voltage drop of $\Delta V_{gd}$ is generated on the electric potential 11 of the pixel electrode 5 under the influence of the coupling capacitance $C_{gd}$ between the gate and the drain. The voltage drop $\Delta V_{gd}$ is referred to as a feed-through voltage and is expressed by the following equation (1):

$$\Delta V_{gd}=\Delta V_g \times C_{gd}/(C_{1c}+C_{gd}+C_{ds}+C_s) \qquad \text{Equation (1)}$$

wherein $\Delta V_g$ represents an amount of voltage change of the gate signal 10.

Then, the electric potential 11 of the pixel electrode 5 is held mainly by the retaining capacitance $C_s$ for one frame.

When the gate signal 10 becomes the Hi level again in a subsequent even frame 102, the electric potential 11 of the pixel 5 becomes the level of the source signal 9. When the gate signal 10 becomes the Lo level, a voltage drop $\Delta V_{gd}$ is also generated. As described above, the voltage drop $\Delta V_{gd}$ is expressed by the equation (1).

On the other hand, a one-dotted chain line 12 shown in FIG. 3 indicates an electric potential of the counter electrode 7, which is generally referred to as a common signal. An electric potential of the common signal 12 can be usually regulated by a variable resistor or the like which is additionally provided, and the absolute values of a voltage $V_o$ to be applied to the liquid crystal in the odd frame 101 and a voltage $V_e$ to be applied to the liquid crystal in the even frame 102 are set to be equal to each other. At that time, the electric potential of the common signal is referred to as an optimum $V_{com}$.

In the LCD using a TFT method, generally, the writing of positive and negative polarities is carried out at a frequency of approximately 60 Hz. Accordingly, in the case in which the absolute values of the voltage $V_o$ to be applied to the liquid crystal in the odd frame and the voltage $V_e$ to be applied to the liquid crystal in the even frame are not equal to each other, so-called a flicker having a frequency of approximately 30 Hz is observed.

Furthermore, in the case in which the absolute values of the voltages $V_o$ and $V_e$ are not set to be equal to each other, the magnitudes of the alternating voltages to be applied to the liquid crystal are not equal to each other with positive and negative polarities. As a result, a DC voltage is applied. At that time, as shown in FIG. 4, an electric charge is moved in a direction of each electrode through the DC voltage applied to a liquid crystal layer.

When the same image is displayed for a long time in the LCD and another image is then displayed, a "sticking" is caused, in which a residual DC is generated and a last image remains as an afterimage.

In order to prevent "sticking" from causing, accordingly, the electric potential of the common signal 12 is regulated to coincide with the center of the electric potential 11 of the pixel electrode 5.

However, the coupling capacitance $C_{1c}$ caused by the liquid crystal in the components of the equation (1) has a dependency on an applied voltage. FIG. 5 shows the relationship between a voltage applied to the liquid crystal and the coupling capacitance $C_{1c}$ caused by the liquid crystal. An axis of abscissa indicates an amplitude $V_{sa}$ of the source signal 9 as the voltage to be applied to the liquid crystal and an axis of ordinate indicates the coupling capacitance $C_{1c}$ caused by the liquid crystal. The value of the coupling capacitance $C_{1c}$ caused by the liquid crystal is varied depending on the voltage to be applied to the liquid crystal, that is, a gradation of an image to be displayed.

Accordingly, the feed-through voltage $\Delta V_{gd}$ expressed in the equation (1) is not always constant but is changed as shown in FIG. 6 depending on the amplitude $V_{sa}$ of the source signal 9, that is, the gradation of the image to be displayed.

As is apparent from FIG. 6, in the case in which the amplitude $V_{sa}$ of the source signal 9 is great, that is, a gradation close to a black color is to be displayed, the feed-through voltage $\Delta V_{gd}$ is low. In the case in which the amplitude $V_{sa}$ of the source signal 9 is small, that is, a gradation close to a white color is to be displayed, the feed-through voltage $\Delta V_{gd}$ is high.

In order to make the absolute values of the voltage $V_o$ to be applied to the liquid crystal in the odd frame and the voltage $V_e$ to be applied to the liquid crystal in the even frame to be equal to each other, it is necessary to set the electric potential of the common signal 12 to be low during a white display with a high feed-through voltage $\Delta V_{gd}$ and to set the electric potential of the common signal 12 to be high during a black display with a low feed-through voltage $\Delta V_{gd}$. This relationship is shown in FIG. 7.

In FIG. 7, an axis of abscissa indicates the amplitude $V_{sa}$ of the source signal 9, that is, a gradation of an image to be displayed, and an axis of ordinate indicates an optimum electric potential $V_{com}$ of the common signal. As is apparent from FIG. 7, the optimum electric potential $V_{com}$ of the common signal is varied every gradation. However, the counter electrode 7 to which the common signal 12 is to be applied is common over the whole region of a screen. Accordingly, when different gradations are displayed in the screen, there is always a pixel which is not given an optimum electric potential $V_{com}$ of the common signal and a DC voltage is applied to cause "sticking".

In order to compensate for the feed-through voltage $\Delta V_{gd}$ to be varied depending on the gradation, therefore, an offset compensation driving is used.

With reference to FIGS. 8 and 9, the principle of the offset compensation driving will be described. As mentioned above, if the amplitude $V_{sa}$ of the source signal 9 is small, the feed-through voltage $\Delta V_{gd}$ is high. Accordingly, as shown in FIG. 8, the central electric potential $V_{so}$ of the source signal 9 is set to be high. On the other hand, if the amplitude $V_{sa}$ of the source signal 9 is large, the feed-through voltage $\Delta V_{gd}$ is low. Accordingly, it is preferable that there is no problem even if the central electric potential $V_{so}$ of the source signal 9 is low.

By setting the central electric potential $V_{so}$ of the source signal 9 as shown in FIG. 8, the electric potential $V_{com}$ of the common signal for causing the absolute values of the voltage $V_o$ to be applied to the liquid crystal in the odd frame and the voltage $V_e$ to be applied to the liquid crystal in the even frame to be equal to each other is almost unchanged over all the gradations as shown in FIG. 9. Accordingly, the electric potential of the common signal 12 to be applied to the counter electrode 7 is made coincident with the electric potential $V_{com}$ in FIG. 9. Consequently, also in the case in which a gradation to be varied in each region of a screen, there is no pixel to which the DC voltage is to be applied and the "sticking" is not caused.

In the case in which the offset compensation driving is to be used, an offset compensation value is set by selecting a position on a screen to obtain the optimum central electric potential $V_{so}$ for each gradation in that position, that is, each amplitude $V_{sa}$ of the source signal 9.

However, the optimum central electric potential $V_{so}$ for each amplitude $V_{sa}$ of the source signal 9 is varied depending on a position in the screen, which is considered to be caused by the following reasons.

(1) The waveform of the gate signal 10 is varied depending on a position in the screen. In the vicinity of an input section for the gate signal, the gate signal 10 has a signal waveform close to an ideal rectangular wave in which a rise and a fall are sharp. When a distance from the input section for the gate signal is increased, the signal waveform has a "rounded" rise and fall. Accordingly, the value of $\Delta V_g$ in the equation (1) is apparently reduced in a position kept apart from the input section for the gate signal. Therefore, the feed-through voltage $\Delta V_{gd}$ is also varied in each position of the screen.

(2) In general, the retaining capacitance $C_s$ has an uneven distribution depending on the position in the screen. Accordingly, the feed-through voltage $\Delta V_{gd}$ expressed by the equation (1) is also varied in each position of the screen.

(3) The characteristic of the liquid crystal is not uniform over the whole screen. For this reason, the coupling capacitance $C_{1c}$ of the liquid crystal also has a distribution depending on the position in the screen. Accordingly, the feed-through voltage $\Delta V_{gd}$ expressed by the equation (1) is also varied in each position of the screen.

For the above-mentioned reasons, the optimum central electric potential $V_{so}$ for each amplitude $V_{sa}$ of the source signal 9, that is, the offset compensation value is varied depending on the position in the screen. Accordingly, even if the offset compensation value is set in a certain position of the screen as in the prior art, the set value is not optimum in other positions. Therefore, the "sticking" is generated.

SUMMARY OF THE INVENTION

As a result of studying the "sticking" for various LCDs, the following conclusion has been drawn.

A first aspect of the present invention is directed to a method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

setting said central electric potential of said source signals and said central electric potential of said common signals, in such a manner as to compensate said reduction of the electric potential induced by said gate signals in a case of the gradation where said amplitude of said source signals is large, and setting said central electric potential of said source signals, in such a manner that said central electric potential of said source signals is higher than said central electric potential of said source signals compensating said reduction of the electric potential induced by said gate signals in case of the gradation where said amplitude of said source signals is small.

As a result, the "sticking" can be relieved over a wide range of a screen.

A second aspect of the present invention is directed to a method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in a pixel where said reduction of an electric potential induced by said gate signals different every gradations is the largest, setting said central electric potential of said source signals and said central electric potential of said common signals, in such a manner as to compensate said reduction of the electric potential induced by said gate signals in a case of the gradation where said amplitude of said source signals is large, and setting said central electric potential of said source signals, in such a manner that said central electric potential of said source signals is higher than said central electric potential of said source signals compensating said reduction of the electric potential induced by said gate signals in case of the gradation where said amplitude of said source signals is small.

As a result, the "sticking" can be relieved over a wide range of a screen.

A third aspect of the present invention is directed to a method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in all gradations, of which amplitude of said source signals is large or small is included, setting a central electric potential of said common signals to be smaller than that in combination of said central electric potential of said common signals with said central electric potential of said source signals to compensate said reduction of the electric potential due to the gate signal.

Consequently, the "sticking" can be reduced for a gradation having a small amplitude of the source signal and the "sticking" is not deteriorated for a gradation having a great amplitude of the source signal.

A fourth aspect of the present invention is directed to a method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in all gradations, of which amplitude of said source signals is large or small is included, setting a central electric potential of said common signals to be smaller than that in combination of said central electric potential of said common signals with said central electric potential of said source signals to compensate said reduction of the electric potential due to the gate signals; and setting a central electric potential of said source signals in gradations, of which amplitude of said source signals is small, to be higher than said combination.

Consequently, it is possible to more enhance the effect of reducing the "sticking" for the gradation having the small amplitude of the source signal.

A fifth aspect of the present invention is directed to a method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in all gradations, of which amplitude of said source signals is large or small is included, setting a central electric potential of said common signals to be smaller than that in combination of said central electric potential of said common signals with said central electric potential of said source signals to compensate said reduction of the electric potential due to the gate signals;

setting a central electric potential of said source signals in gradations, of which amplitude of said source signals is small, to be higher than said combination; and setting a central electric potential of said source signals in gradations, of which amplitude of said source signals is large, to be higher than said combination.

Consequently, the "sticking" can be reduced, and furthermore, display failures such as a flicker of a screen, a shot unevenness and the like are not caused.

DETAILED DESCRIPTION

Preferred embodiments of the present invention will be described below.

Embodiment 1

EMBODIMENT 1 of the present invention will be described with reference to FIG. 10.

Figure 1:
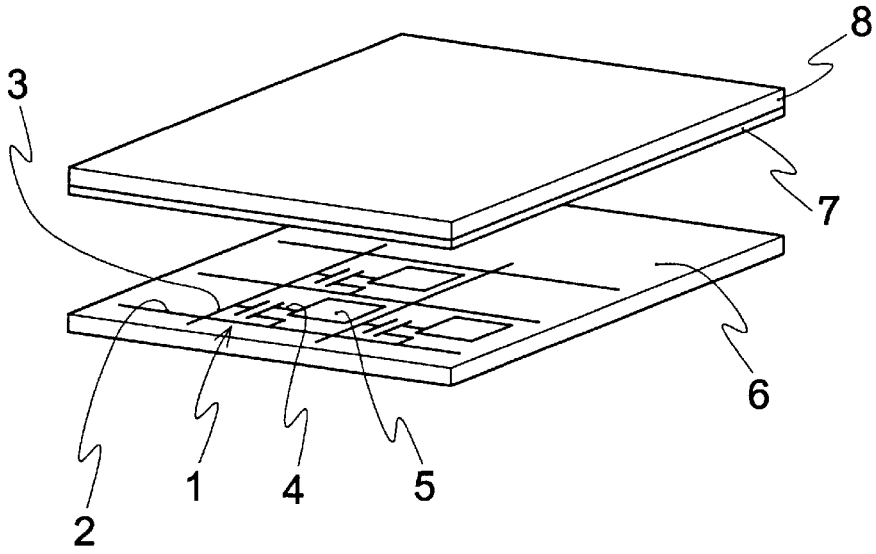
FIG. 1 is an explanatory view showing a construction of a liquid crystal display using a TFT.
Figure 2:
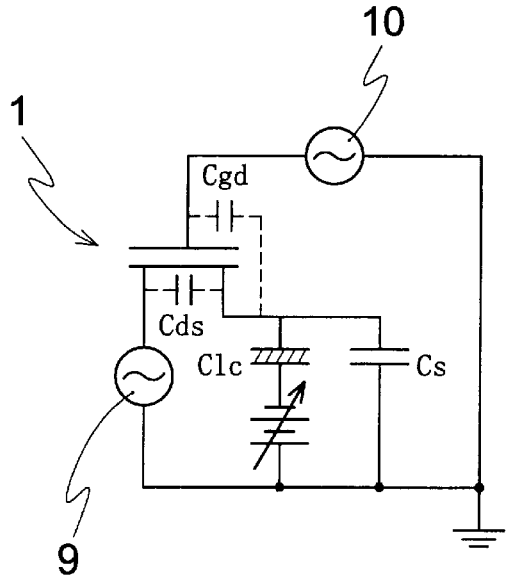
FIG. 2 is an explanatory view illustrating an equivalent circuit of a pixel.
Figure 3:
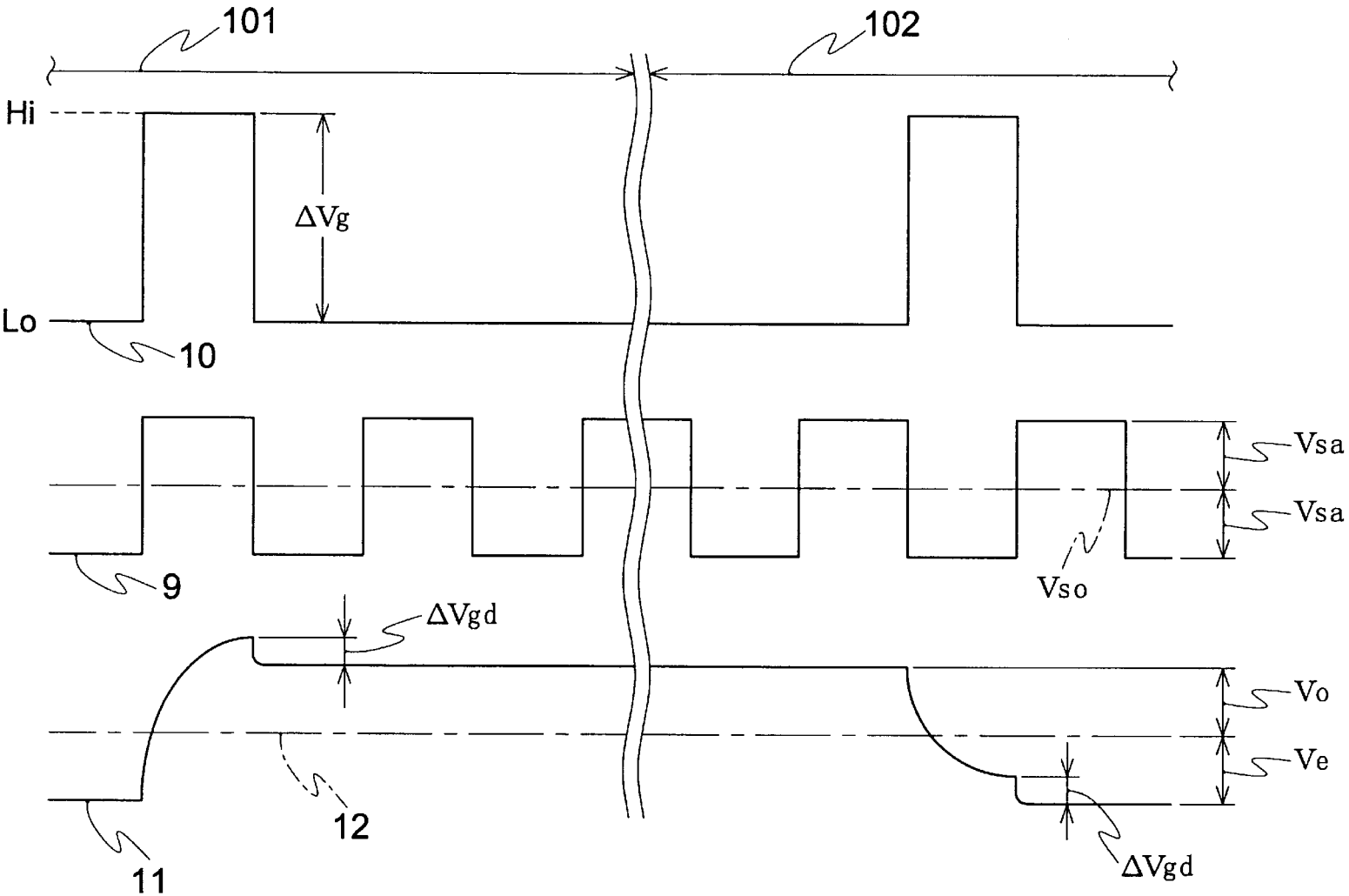
FIG. 3 is a graph showing a waveform of a signal applied to a pixel.
Figure 4:
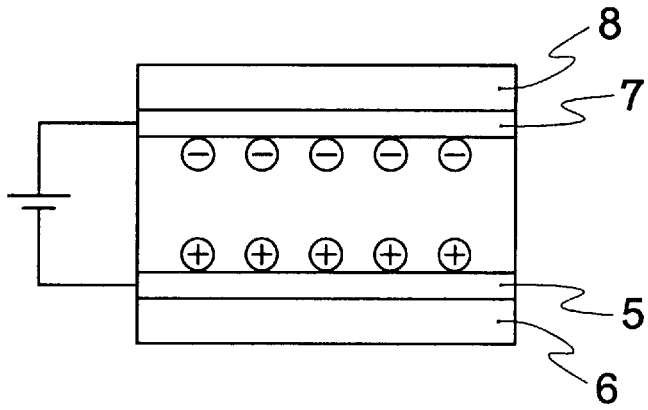
FIG. 4 is an explanatory view showing a principle of sticking phenomenon.
Figure 5:
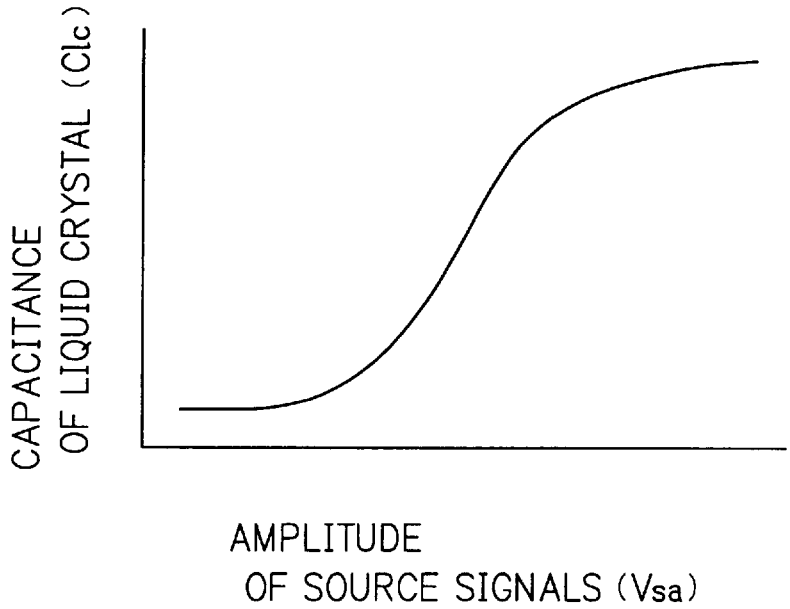
FIG. 5 is a graph showing a relation between a voltage applied to liquid crystal and a combined capacitance $C_{1c}$ caused by the liquid crystal.
Figure 6:
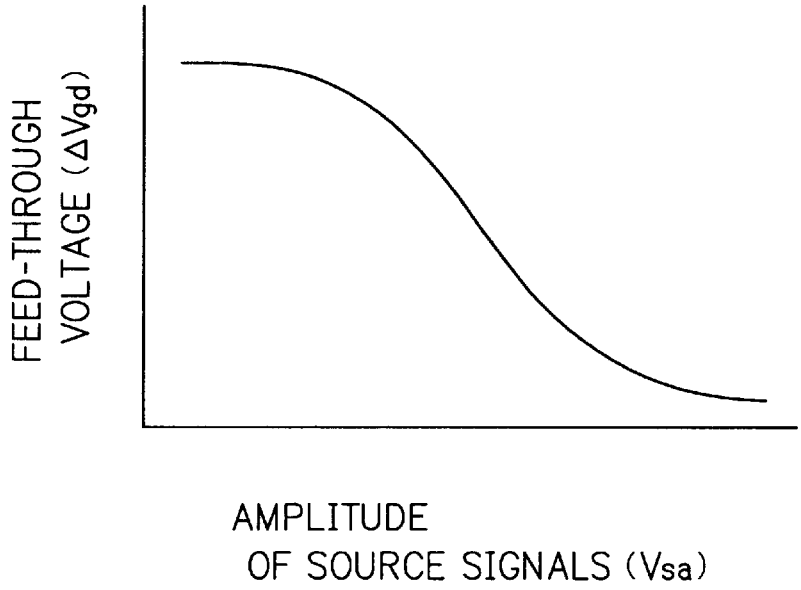
FIG. 6 is a graph showing a relation between an amplitude $V_{sa}$ of a source signal 9 and field-through voltage $\Delta V_{gd}$.
Figure 7:
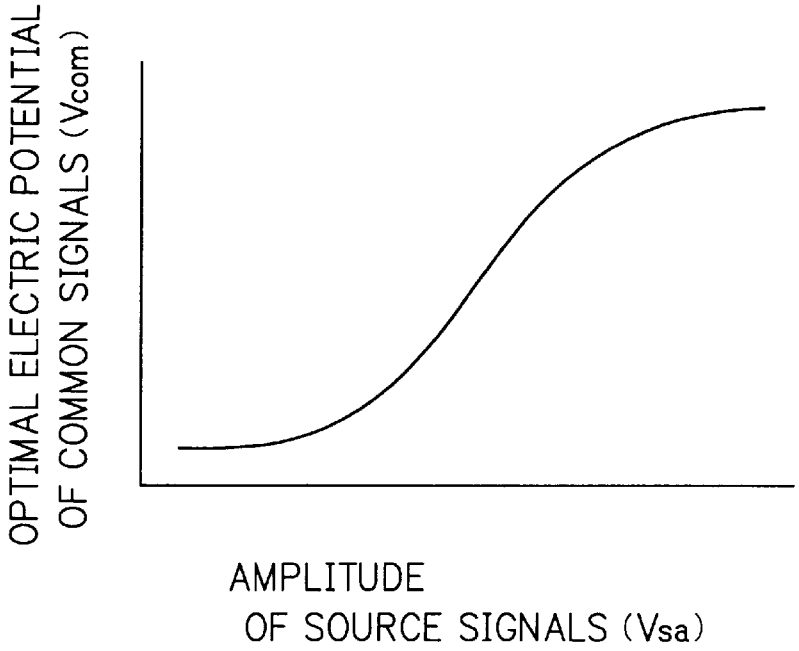
FIG. 7 is a graph showing an electric potential $V_{com}$ of optimal common signal to each amplitude $V_{sa}$ when an offset compensation is not performed.
Figure 8:
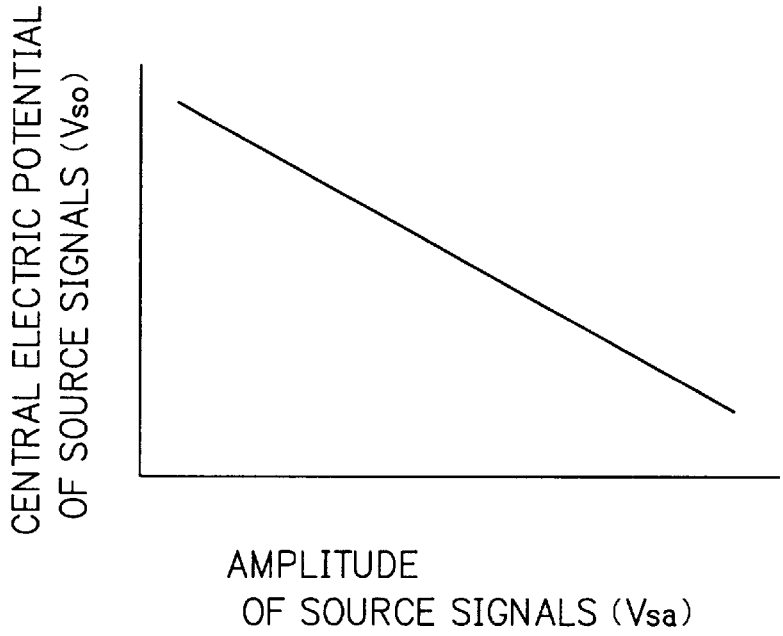
FIG. 8 is an explanatory view showing a principle of the offset compensation.

As described above, in the prior art, the central electric potential $V_{so}$ of the source signal 9 is set in consideration of the fact that the feed-through voltage $\Delta V_{gd}$ is high during a white display in which the amplitude $V_{sa}$ of the source signal 9 is small and is low during a black display in which the amplitude $V_{sa}$ of the source signal 9 is large as shown in FIG. 8.

Figure 9:
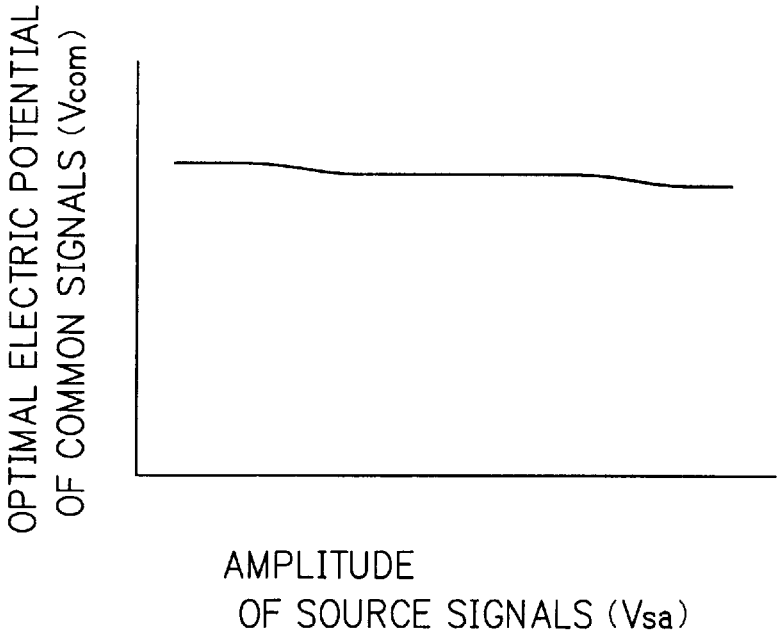
FIG. 9 is a graph is a graph showing the electric potential of the optimal common signal to each source signal 9.

As shown in FIG. 9, consequently, an optimum electric potential $V_{com}$ of a common signal for each gradation is almost unchanged and a single counter electrode can supply the optimum electric potential $V_{com}$ of a common signal for each gradation.

Figure 10A:
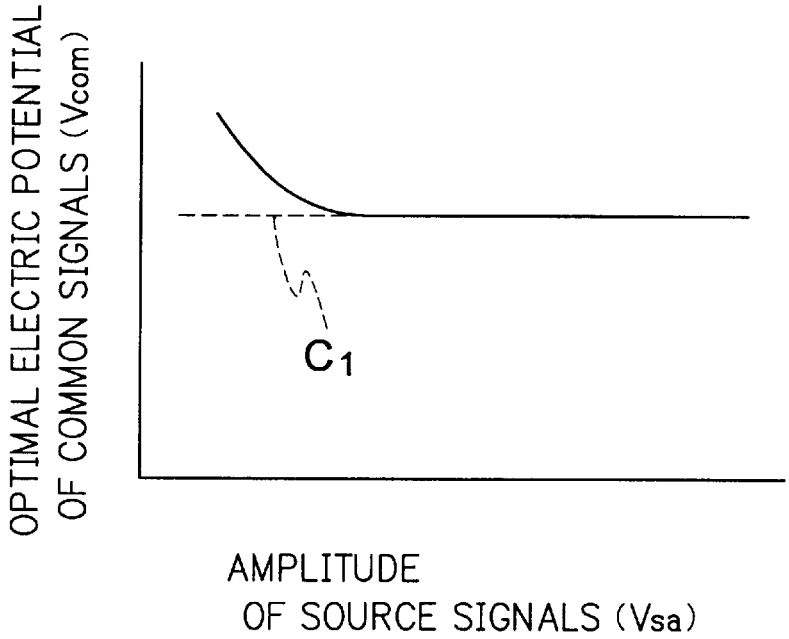
FIG. 10 is a graph showing a state where a set according to EMBODIMENT 1 is carried out.
Figure 10B:
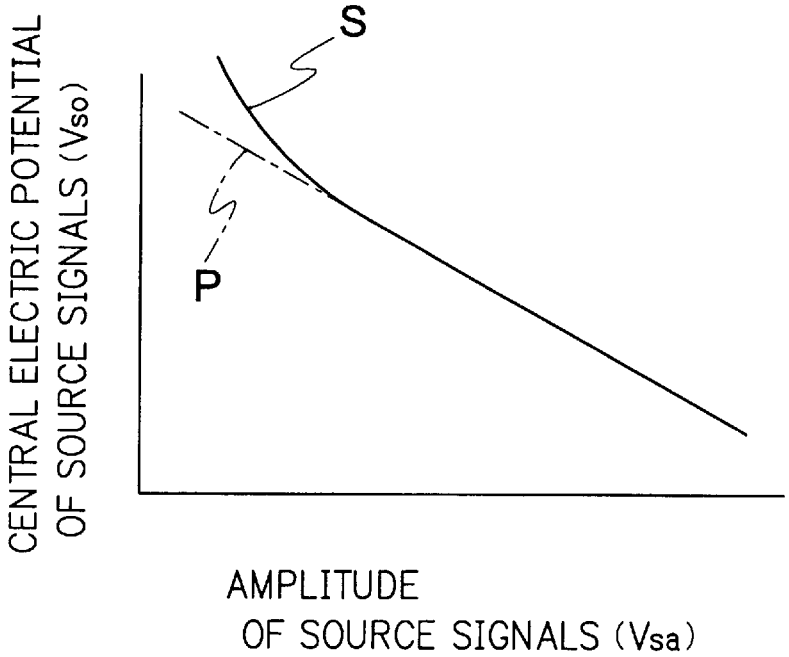

In the present embodiment, however, the central electric potential $V_{so}$ of the source signal 9 is set to be even higher in a region where the amplitude $V_{sa}$ of the source signal 9 is small as shown in a curve S of FIG. 10(*b*) than the setting according to the prior art shown in a one-dotted chain line P of FIG. 10(*b*). At this time, the optimum electric potential $V_{com}$ of the common signal for each gradation, that is, for each $V_{sa}$ is obtained as shown in FIG. 10(*a*) so that a single counter electrode cannot supply the optimum electric potential $V_{com}$ of the common signal for each gradation. As shown in a broken line $C_1$ of FIG. 10(*a*), therefore, an electric potential of a common signal 12 is set corresponding to the optimum electric potential $V_{com}$ of the common signal in a region where the amplitude $V_{sa}$ of the source signal 9 is large, that is, the region for the black display.

In the prior art, it was supposed that the setting according to the present embodiment is not practical because "sticking" and a flicker become remarkable in the region for the white display. However, the present inventor has found that the setting according to the present embodiment can actually relieve a "sticking".

The reason is that the structure of an LCD is not symmetrical. For example, the shape of the pixel electrode 5 is different from that of the counter electrode 7, and the thicknesses and qualities of protective films provided on surfaces of both opposed substrates are also different from each other. For this reason, it is supposed that the condition of movement of electric charges in each electrode direction is varied and the generation of a residual DC depends on a polarity of a voltage to be applied to a liquid crystal.

Figure 17:
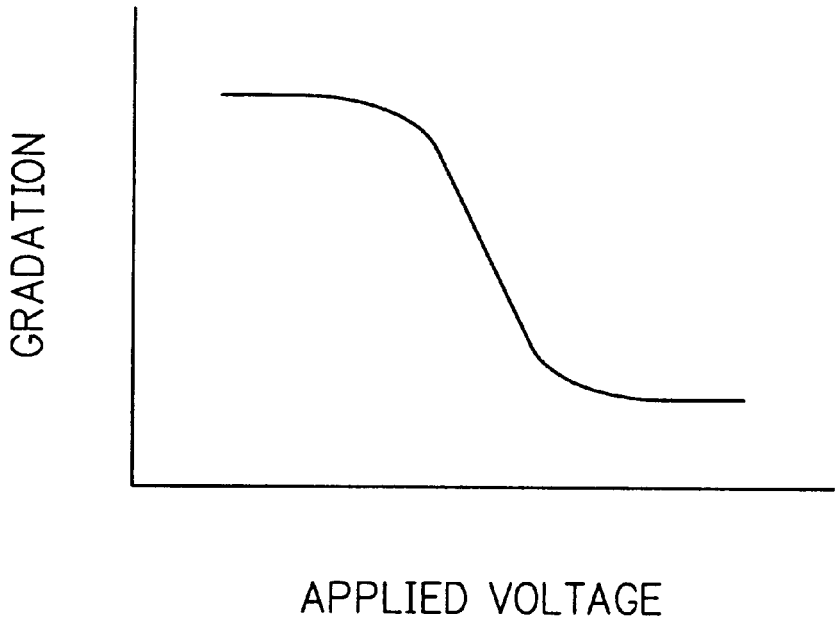
FIG. 17 is a graph showing a relation between a voltage applied to the liquid crystal and a displayed gradation.

Moreover, a voltage-gradation characteristic of the liquid crystal is shown in FIG. 17, and the gradation is rarely changed even if an applied voltage is varied in a region close to white or black. Accordingly, the setting according to the present embodiment causes a flicker to be rarely observed even if a voltage $V_o$ to be applied to the liquid crystal in an odd frame is slightly different from a voltage $V_e$ to be applied to the liquid crystal in an even frame.

Embodiment 2

EMBODIMENT 2 of the present invention will be described with reference to FIG. 11.

Figure 11A:
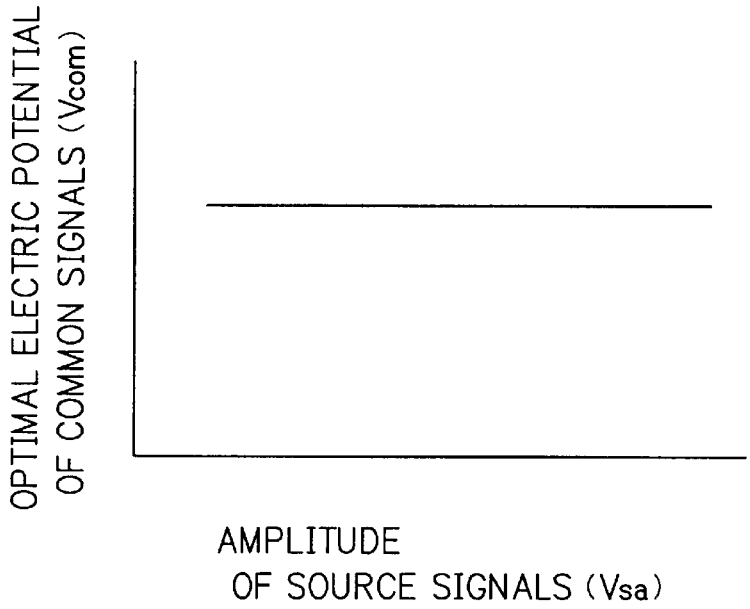
FIG. 11 is a graph showing a state where a set according to EMBODIMENT 2 is carried out.
Figure 11B:
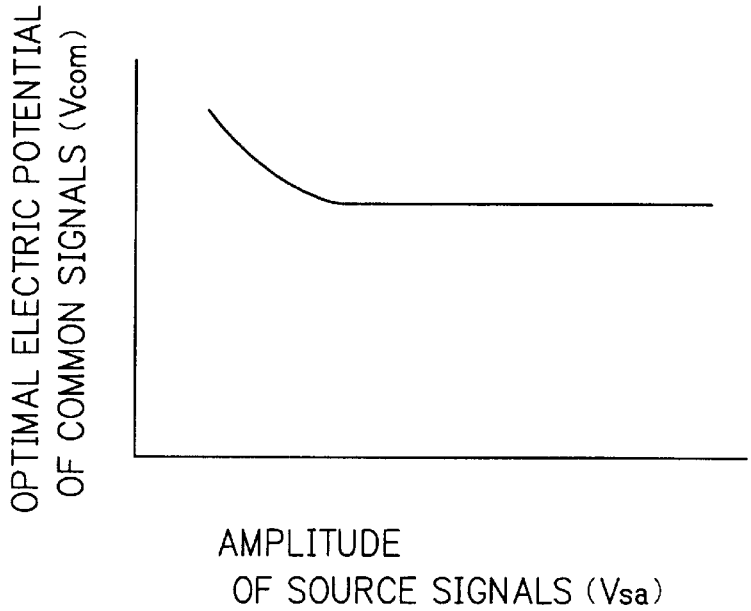

In the present embodiment, a central electric potential $V_{so}$ of a source signal is set such that an optimum electric potential $V_{com}$ of a common signal for each gradation is almost constant, that is, a state shown in FIG. 11(*a*) can be obtained in a position of a screen where a feed-through voltage $\Delta V_{gd}$ is the highest. At this time, the optimum electric potential $V_{com}$ of the common signal for each gradation has a value shown in FIG. 11(*b*) in other positions of the screen.

For the reason described in the first embodiment, accordingly, it is possible to obtain a display having no sticking in a wide region of the screen.

A position where the feed-through voltage $\Delta V_{gd}$ is highest is generally close to an input section for a gate signal, and can be experimentally recognized as a position where the electric potential of the common signal without a flicker observed is the lowest.

Embodiment 3

EMBODIMENT 3 of the present invention will be described with reference to FIG. 12.

Figure 12A:
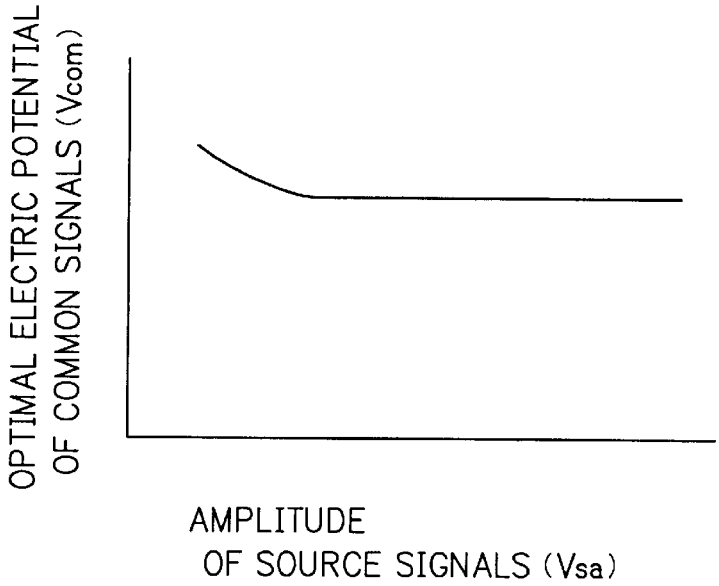
FIG. 12 is a graph showing a state where a set according to EMBODIMENT 3 is carried out.
Figure 12B:
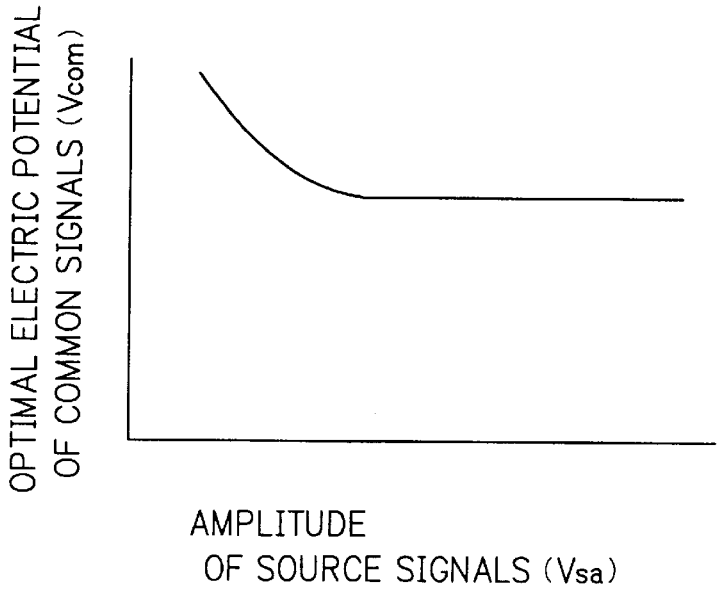

According to the present embodiment, in a position of a screen where a feed-through voltage $\Delta V_{gd}$ is the highest, an optimum electric potential $V_{com}$ of a common signal is set to be almost constant in a region where an amplitude $V_{sa}$ of a source signal 9 is large and a central electric potential $V_{so}$ of a source signal 9 is set such that the optimum electric potential $V_{com}$ of the common signal in a region where the amplitude $V_{sa}$ of the source signal 9 is small is higher than that in a region where the amplitude $V_{sa}$ of the source signal 9 is large as shown in FIG. 12(*a*).

At this time, the relationship between the amplitude $V_{sa}$ of the source signal 9 and the optimum electric potential $V_{com}$ of the common signal shown in FIG. 12(*b*) are obtained in other positions of the screen.

For the reason described in the first embodiment, accordingly, it is possible to obtain a display having no sticking in a wide region of the screen.

As described above, a position where the feed-through voltage $\Delta V_{gd}$ is highest is generally close to an input section for a gate signal, and can be experimentally recognized as a position where the electric potential of the common signal without a flicker observed is the lowest.

Embodiment 4

Figure 13:
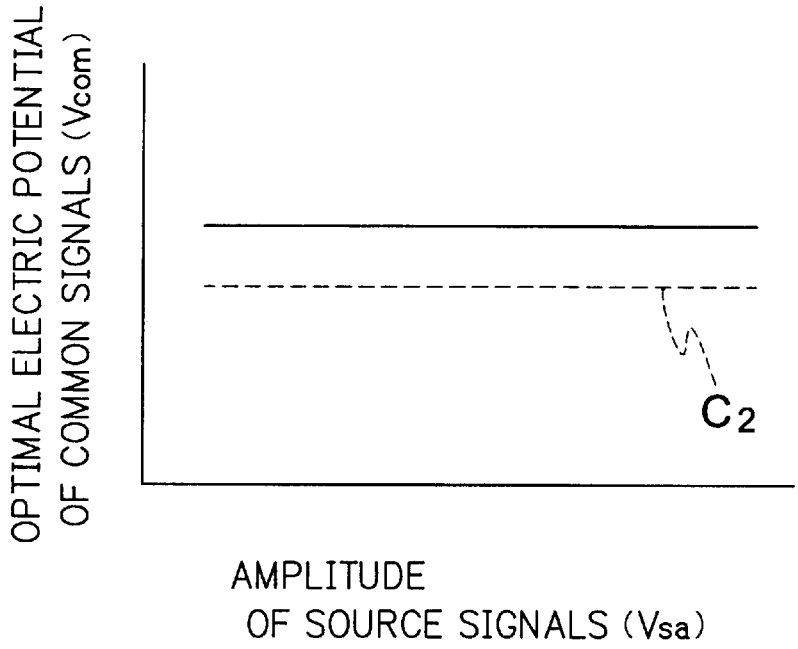
FIG. 13 is a graph showing a state where a set according to EMBODIMENT 4 is carried out.

EMBODIMENT 4 of the present invention will be described with reference to FIG. 13.

In the present embodiment, offset compensation is carried out, that is, a central electric potential $V_{so}$ of a source signal 9 is set such that an optimum electric potential $V_{com}$ of a common signal is almost constant for each gradation.

In the prior art, the electric potential of the common signal is made coincident with the optimum electric potential $V_{com}$ of the common signal. In the present embodiment, however, the electric potential of the common signal is set to have a low value for the optimum electric potential $V_{com}$ of the common signal as shown in $C_2$ of the drawing.

In the prior art, it has been supposed that the setting according to the present embodiment causes a sticking and a flicker for all gradations and is not practical.

However, the setting according to the present embodiment can actually relieve a sticking in a region where an amplitude $V_{sa}$ of the source signal 9 is small, that is, a region for a white display and a flicker is rarely observed as described above.

Furthermore, the present inventor has found that the setting according to the present embodiment does not deteriorate the sticking in a region where the amplitude $V_{sa}$ of the source signal 9 is great, that is, a region for a black display.

Figure 14:
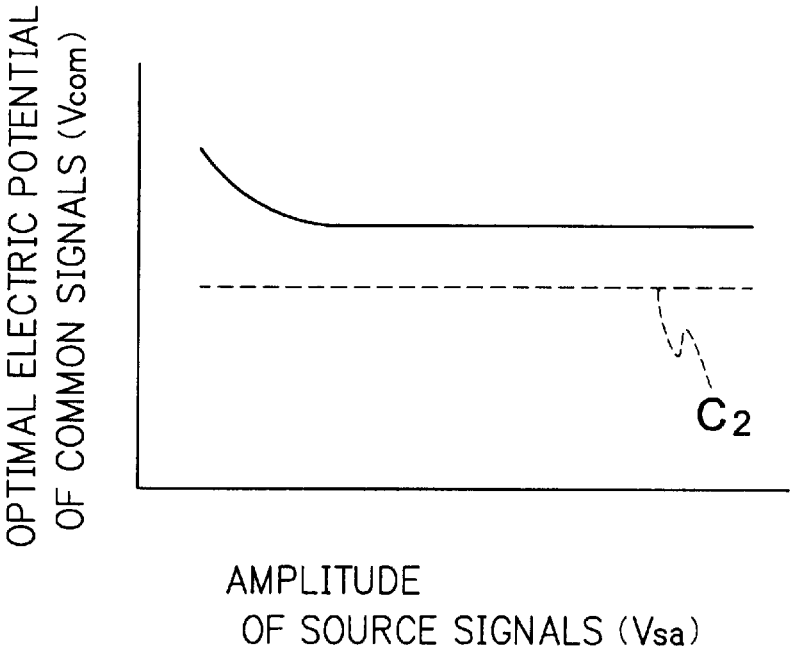
FIG. 14 is a graph showing a state where a set according to EMBODIMENT 4 is carried out.

While the offset compensation is carried out, that is, the central electric potential $V_{so}$ of the source signal 9 is set such that the optimum electric potential $V_{com}$ of the common signal for each gradation is almost constant in the present embodiment, the central electric potential $V_{so}$ of the source signal 9 may be set such that the optimum electric potential $V_{com}$ of the common signal is high in the region where the amplitude $V_{sa}$ of the source signal 9 is small, that is, a region for a white display as shown in FIG. 14.

It is possible to further relieve the sticking in the region where the amplitude $V_{sa}$ of the source signal 9 is small.

Embodiment 5

Figure 15:
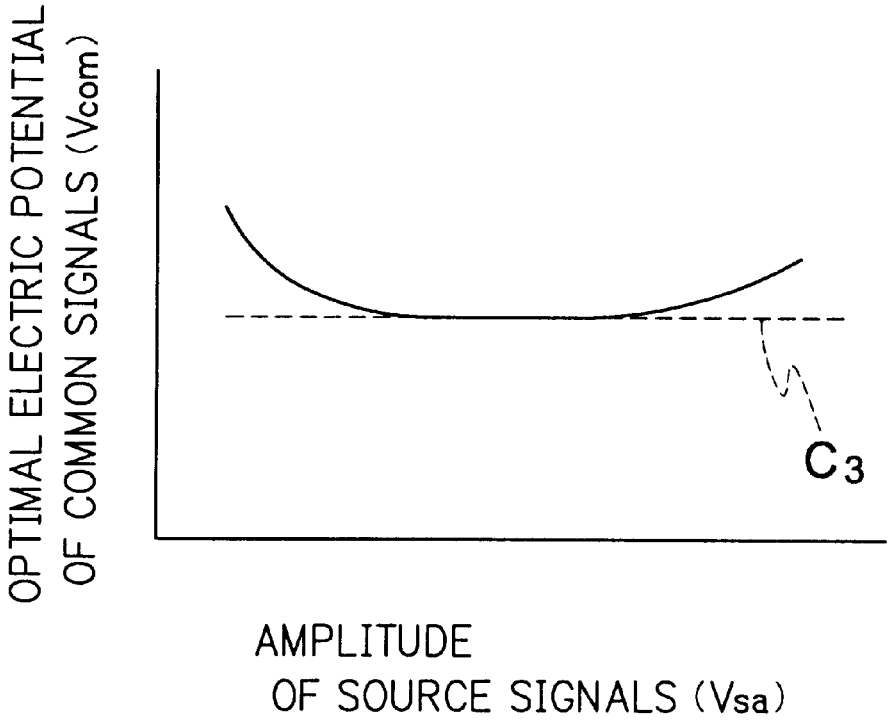
FIG. 15 is a graph showing a state where a set according to EMBODIMENT 5 is carried out.

EMBODIMENT 5 of the present invention will be described with reference to FIG. 15.

In the present embodiment, an optimum electric potential $V_{com}$ of a common signal in regions where an amplitude $V_{sa}$ of a source signal 9 is large and where it is small are set to be higher than the optimum electric potential $V_{com}$ of the common signal for an intermediate gradation.

The electric potential of the common signal is set to the optimum electric potential $V_{com}$ of the common signal for the intermediate gradation, that is, a one-dotted chain line $C_3$ in the drawing.

In the present embodiment, the optimum electric potential $V_{com}$ of the common signal in the regions where the amplitude $V_{sa}$ of the source signal 9 is great and small is set to be higher than the electric potential $C_3$ of the common signal. For the same reason as that in the fourth embodiment, accordingly, sticking can be reduced.

In the present embodiment, furthermore, the optimum electric potential $V_{com}$ of the common signal in an intermediate gradation region is almost coincident with the electric potential $C_3$ of the common signal. Therefore, display failures such as a flicker of a screen, a shot unevenness and the like are not caused.

Embodiment 6

A specific example of offset voltage setting to which the present invention is applied will be described with reference to FIG. 16.

Figure 16A:
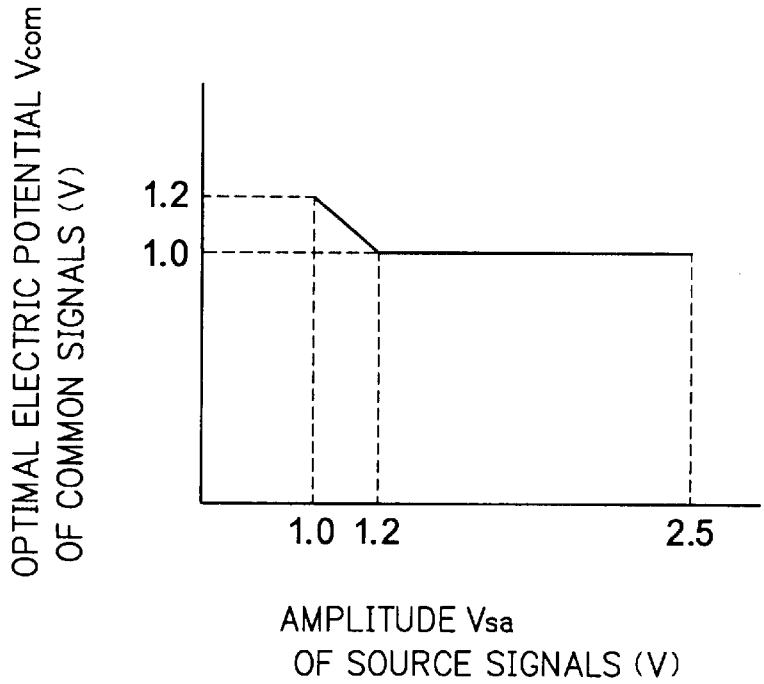
FIG. 16 is a graph showing a state where a concrete set according to the present invention is carried out.
Figure 16B:
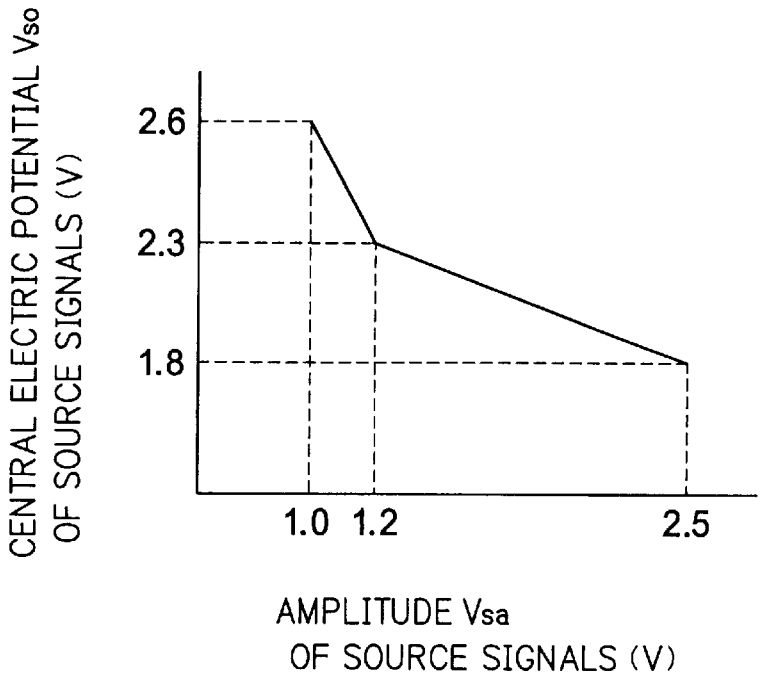

In an LCD manufactured on trial, an offset compensation value was set as shown in FIG. 16(*b*). The offset compensation value was set such that a central electric potential $V_{so}$ of a source signal is increased when an amplitude $V_{sa}$ of the source signal is reduced. In particular, the central electric potential $V_{so}$ of the source signal is set yet higher in a region where the amplitude $V_{sa}$ of the source signal is 1.0 to 1.2 V.

Referring to the LCD thus set, a position where a feed-through voltage $\Delta V_{gd}$ is the highest was experimentally identified and an optimum electric potential $V_{com}$ of the common signal was measured for the amplitude $V_{sa}$ of each source signal in that position. Consequently, the relationship shown in FIG. 16(*a*) was obtained. In a region where the amplitude $V_{sa}$ of the source signal is 1.2 to 2.5 V, the optimum electric potential $V_{com}$ of the common signal was constant, that is, 1.0 V. When the amplitude $V_{sa}$ of the source signal was 1.0 V, the optimum electric potential $V_{com}$ of the common signal was 1.2 V.

While the electric potential of the common signal to be applied to a counter electrode was set to 1.0 V and a white color was displayed over the whole surface of the LCD, a flicker was not observed.

Next, check pattern were displayed over the whole surface of the LCD for a long time, sticking was not caused.

In the detailed description and drawings of the present invention which have been explained above, the common signal has been explained as a DC potential. Also in the case of an alternating signal in which a polarity is inverted every scanning line depending on a method of driving the LCD, the present invention can be applied.

According to the present invention, also in the case in which the same image is displayed for a long time, a sticking is not caused and a flicker is not generated. Therefore, it is possible to obtain a liquid crystal display having a high picture quality.

The forgoing is considered as illustrative only of the principles of the invention. Further, because numerous modifications and changes will readily occur to those skilled in the art, it is not desired to limit the invention to the exact construction and operation shown and described, and accordingly all suitable modifications and equivalents may be resorted to falling within the scope of the invention as definition by the claims which follows.

What is claimed is:

1. A method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

setting said central electric potential of said source signals and said central electric potential of said common signals, in such a manner as to compensate said reduction of the electric potential induced by said gate signals in a case of the gradation where said amplitude of said source signals is large, and setting said central electric potential of said source signals, in such a manner that said central electric potential of said source signals is higher than said central electric potential of said source signals compensating said reduction of the electric potential induced by said gate signals in case of the gradation where said amplitude of said source signals is small.

2. The method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

setting said central electric potential of said common signals and said central electric potential of said source signals in a pixel where said reduction of the electric potential induced by said gate signals different every gradations is the largest, in such a manner that said reduction of the electric potential induced by said gate signals is compensated in all gradations for large through small amplitude of said source signals.

3. The method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in a pixel where said reduction of an electric potential induced by said gate signals different every gradations is the largest, setting said central electric potential of said source signals and said central electric potential of said common signals, in such a manner as to compensate said reduction of the electric potential induced by said gate signals in a case of the gradation where said amplitude of said source signals is large, and setting said central electric potential of said source signals, in such a manner that said central electric potential of said source signals is higher than said central electric potential of said source signals compensating said reduction of the electric potential induced by said gate signals in case of the gradation where said amplitude of said source signals is small.

4. A method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in all gradations, of which amplitude of said source signals is large or small is included, setting a central electric potential of said common signals to be smaller than that in combination of said central electric potential of said common signals with said central electric potential of said source signals to compensate said reduction of the electric potential due to the gate signal.

5. A method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in all gradations, of which amplitude of said source signals is large or small is included, setting a central electric potential of said common signals to be smaller than that in combination of said central electric potential of said common signals with said central electric potential of said source signals to compensate said reduction of the electric potential due to the gate signals; and setting a central electric potential of said source signals in gradations, of which amplitude of said source signals is small, to be higher than said combination.

6. A method of driving a liquid crystal display, where said liquid crystal display comprising:

two substrates which are opposed to each other in such a manner that a liquid crystal layer is interposed between said two substrates;

a source line, to which source signals are fed, said source line being provided on one of said two substrates;

a gate line, to which gate signals are fed, said gate line being provided on said one of said two substrates;

a TFT element connected with said source line and said gate line;

a pixel electrode connected with a drain of said TFT element;

a counter electrode, to which common signals of direct or alternating current is applied, said counter electrode being provided on the other one of said two substrates;

wherein an amplitude of said source signals is varied so as to vary an electric potential of said pixel electrode, whereby a potential difference between said pixel electrode and said counter electrode is varied to change an alignment of liquid crystal molecules, so that gradation displayed on a pixel is controlled;

wherein a central electric potential of common signals applied on said counter electrode can be set to compensate a reduction of an electric potential of said pixel electrode induced by changing an electric potential of the gate signals;

wherein a central electric potential of said source signals can be varied every gradations to compensate a reduction of an electric potential induced by said gate signals which are different every gradations;

said method comprising steps of:

in all gradations, of which amplitude of said source signals is large or small is included, setting a central electric potential of said common signals to be smaller than that in combination of said central electric potential of said common signals with said central electric potential of said source signals to compensate said reduction of the electric potential due to the gate signals;

setting a central electric potential of said source signals in gradations, of which amplitude of said source signals is small, to be higher than said combination; and setting a central electric potential of said source signals in gradations, of which amplitude of said source signals is large, to be higher than said combination.

* * * * *